US006149732A

United States Patent [19]

Carlisle

[11] Patent Number: 6,149,732

[45] Date of Patent: Nov. 21, 2000

[54] METHOD AND APPARATUS FOR REMOVING PLASTIC RESIDUE

[75] Inventor: J. Drake Carlisle, Palm Harbor, Fla.

[73] Assignee: Genca Corporation, Clearwater, Fla.

[21] Appl. No.: 09/179,900

[22] Filed: Oct. 28, 1998

[51] Int. Cl.[7] ..... B08B 7/02

[52] U.S. Cl. ..... 134/6; 134/7; 134/8; 134/16; 134/17; 134/19; 134/22.1; 134/22.11; 134/22.19; 134/38; 432/75

[58] Field of Search ..... 432/75; 134/16, 134/6–8, 17, 19, 22.1, 22.11, 22.19, 38

[56] References Cited

U.S. PATENT DOCUMENTS

| | | | |
|---|---|---|---|
| 3,948,679 | 4/1976 | Lewis | 134/10 |
| 4,627,197 | 12/1986 | Klee et al. | 51/319 |
| 4,768,535 | 9/1988 | Marx et al. | 134/169 R |
| 4,823,819 | 4/1989 | Schmidt | 134/104.4 |
| 4,954,180 | 9/1990 | Malloy | 134/22.13 |
| 4,979,338 | 12/1990 | Schmitz, II et al. | 51/423 |
| 5,091,034 | 2/1992 | Hubert | 156/344 |
| 5,456,085 | 10/1995 | Popp et al. | 62/64 |
| 5,512,104 | 4/1996 | Mizushiri et al. | 134/1 |
| 5,606,860 | 3/1997 | Popp et al. | 62/63 |
| 5,761,912 | 6/1998 | Popp et al. | 62/51.1 |
| 5,891,261 | 4/1999 | Mizukawa et al. | 134/19 |

*Primary Examiner*—Sharidan Carrillo
*Attorney, Agent, or Firm*—Blank Rome Comisky & McCauley LLP

[57] ABSTRACT

Equipment used in the processing of plastic, such as molds and extrusion screws, is cleaned of plastic residue by a combination of thermal cycling and agitation without impact cleaning. A chamber can be heated by an electric radiant heater and cooled by the introduction of liquid nitrogen. A fixture in the chamber receives the equipment to be cleaned and is agitated by a drive motor. The chamber is heated and cooled in the following cycle in which the drive motor agitates the fixture: first to 250–300° F., then to −315° F., then cycled between −50° F. and −10° F., then to 150° F., then to −200° F., then to 100° F., then to ambient temperature. The chamber is controlled by a computer that prompts the operator for the kind of plastic to be cleaned off of the equipment and then controls the heating and cooling automatically.

8 Claims, 3 Drawing Sheets

METHOD AND APPARATUS FOR REMOVING PLASTIC RESIDUE

BACKGROUND OF THE INVENTION

The present invention is directed to a method of and an apparatus for removing residual plastic from plastic processing equipment. Such equipment can include molds, extruding screws, extruding pipes and the like. The present invention can also be used for removing the residue of materials other than plastics, such as enamel and varnish.

The equipment used in processing plastics has traditionally been cleaned with either heat or chemical solvents. However, heat can degrade the equipment; for example, it can degrade steel tools by altering the grain structure of the steel. Chemical solvents may also degrade certain tools; more importantly, it is often difficult to dispose of the used solvents in an environmentally acceptable manner.

Some industries use impact cleaning methods such as scraping and blasting. For example, in the printing industry, cans having ink residue are frozen, and the frozen ink is scraped off. However, such methods are not suitable in all industries. The scraping or other impact may damage high-precision equipment; also, some tools, such as extruding screws, are too intricate to scrape efficiently.

It is also known in the art to clean equipment with pressurized gas, e.g., $CO_2$. However, the force of pressurized $CO_2$ does not suffice to clean the equipment in all cases.

The combination of extreme cold and blasting has been used to deflash molded articles, or in other words, to remove the residual material left on the articles between the interfacing mold surfaces. An example of this technique is taught in U.S. Pat. No. 4,979,338 to Schmitz, II et al. Similar techniques have been employed to remove an adherent coating from an article, as taught in U.S. Pat. No. 4,627,197 to Klee et al and in U.S. Pat. No. 5,761,912 to Popp et al. However, those techniques do not effectively and efficiently remove all of the residue without the need for impact cleaning.

SUMMARY AND OBJECTS OF THE INVENTION

In view of the foregoing, it should be apparent that there still exists a need in the art for a method and apparatus for removing plastic residue from plastic working tools and equipment so as to harm neither the equipment nor the environment. It is, therefore, a primary object of the invention to remove residual plastic from plastic processing equipment through a cold process so as not to degrade the equipment.

It is another object of the invention to remove residual plastic from plastic processing equipment in an environmentally acceptable manner.

It is still another object of the invention to remove residual plastic from plastic processing equipment without the use of scraping or other impact.

To achieve these and other objects, the present invention is directed to an apparatus and method in which the equipment is agitated while the temperature is cycled through a variety of heating cycles, some involving extremely cold temperatures. Since different materials have different degrees of thermal expansion and contraction, the combination of the thermal cycling and the vibrational energy breaks the adhesive bond between the plastic residue and the material of which the equipment is made, typically steel.

The contaminated equipment is loaded into a fixture, which is placed in a thermal chamber. The chamber is heated, typically to 250–300° F., and held at that temperature. The high temperature both removes excess moisture from the chamber and thermally expands the equipment, so that the plastic "breathes" and starts to break. Then, the bottom of the chamber is flooded with liquid nitrogen ($LN_2$) so that the chamber rapidly cools to −315 ° F. The vapors of the $LN_2$ cool the equipment and the plastic and the equipment shrinks more rapidly than the plastic. During the cooling, the fixture is agitated to vibrate the equipment, thus assisting in the separation of the plastic from the metal. Impact is not required to remove the plastic.

The chamber is then heated to −10° F. to achieve a phase change in the plastic, namely, from ductile to brittle. The temperature in the chamber is then cycled twice between −50° F. and −10° F. to induce a phase change in the plastic and thereby to fatigue the plastic. Then the temperature is elevated to 150° F., held at that temperature for a time and plunged back down to −200° F. Throughout the various temperature cycles, the fixture is agitated. The repeated phase changes fatigue the plastic. That fatigue and the differing degrees of expansion and contraction of the steel and the plastic allow a complete separation between the plastic and the steel under the agitating force and in particular prevent the plastic and steel from bonding back together.

At the end of the temperature cycling, the chamber is brought up to 100° F. and then to ambient temperature. When the nitrogen gas is vented and the chamber is opened, the fixture can be removed to remove the equipment therefrom. The plastic separated from the equipment is at the bottom of the fixture and can easily be removed.

The chamber is preferably made of stainless steel on the inside. Of course, it is preferred that no component exposed to the thermal cycling within the chamber be made of plastic or any other material to be separated from the equipment, so that the chamber does not destroy itself. The fixture is mounted on rails, and an agitating motor is supplied outside the chamber, with a rod or the like extending into the chamber to agitate the fixture. The rod extends through bearings capable of resisting the operation of the chamber. Heaters, fans, and an inlet for the introduction of $LN_2$ into the chamber are provided. The nitrogen vapor can be vented in various ways in accordance with the environment in which the chamber is to be used.

The above operations can be performed under the control of a computer. Sensors and control devices can be provided to effect such control.

BRIEF DESCRIPTION OF THE DRAWINGS

A preferred embodiment of the invention will now be set forth in detail with reference to the drawings, in which.

DETAILED DESCRIPTION OF THE PREFERRED EMBODIMENT

Figure 1:
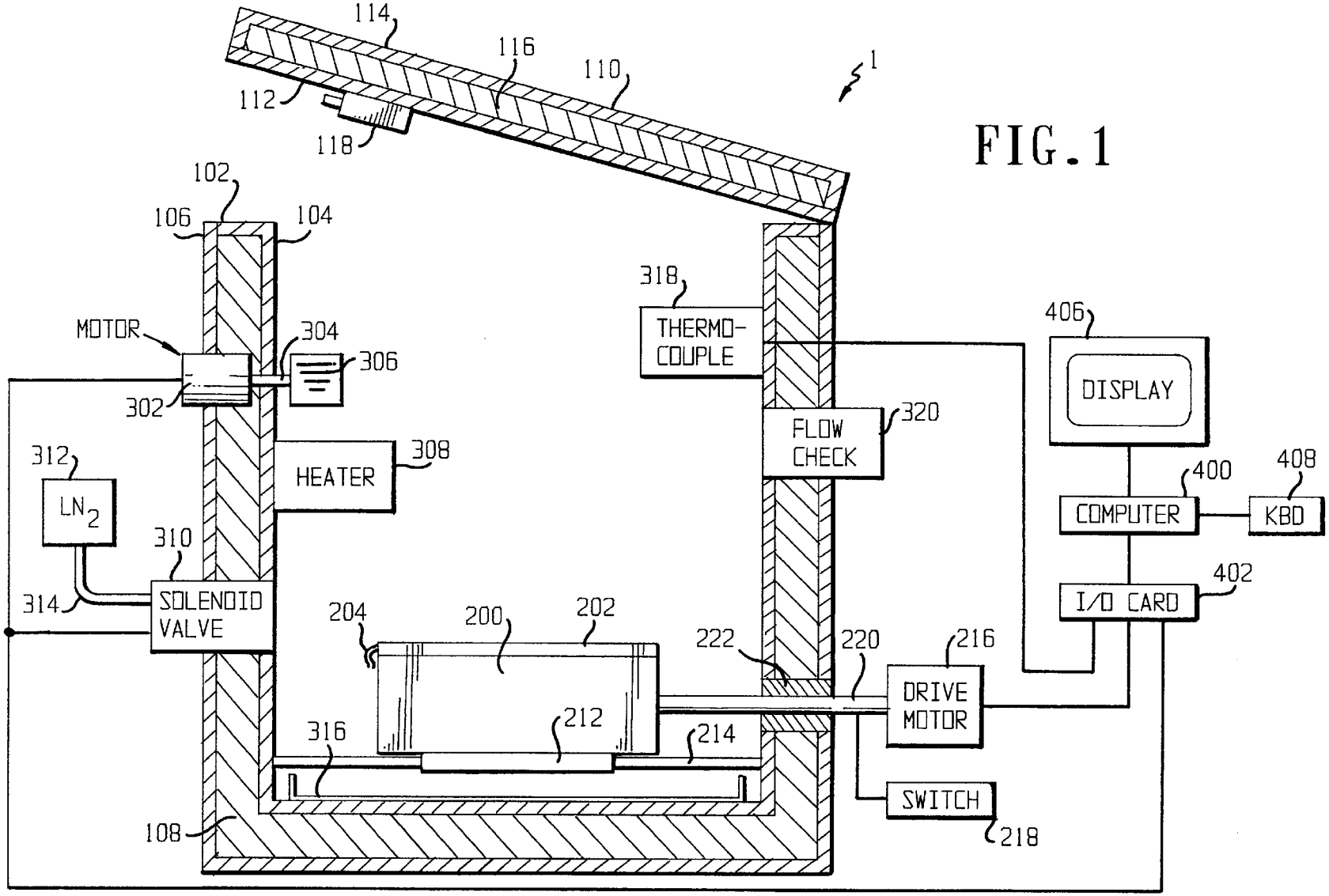
FIG. 1 is a drawing showing an overview of an apparatus according to the present invention.

A preferred embodiment of the present invention will now be set forth in detail with reference to the figures, in which like components are designated by like reference numerals throughout.

FIG. 1 shows an overview of an apparatus 1 according to the preferred embodiment. The apparatus 1 has a chamber 102 in which the thermal cycling takes place. The chamber 102 has an inner wall 104 formed of 304 stainless steel. That material is selected because it does not rust, even under the conditions of high condensation that occur during the thermal cycling, and because it handles the thermal cycling well. The chamber 102 also has an outer wall 106.

Three sets of internal dimensions of the chamber are contemplated for use with conventional plastic processing equipment: 2'×2'×2', 3'×4'×5', and 8'×2'×2', with the vertical dimension given first in each case. The last set of dimensions is for the screws and pipes used in extrusion. Of course, other dimensions could be provided as needed for other types of equipment.

A gap of three inches is provided between the inner wall 104 and the outer wall 106. This gap is filled with a polyamide insulation 108, which is a good insulation for a temperature range from −500° F. to 500° F.

The chamber has a lid 110 with an inner wall 112, an outer wall 114 and insulation 116 similar to the inner wall 104, the outer wall 106 and the insulation 108 of the remainder of the chamber. The lid 110 also has an air solenoid 118 to lock the lid 110 in a closed position throughout the operation of the chamber 102.

Figure 2A:
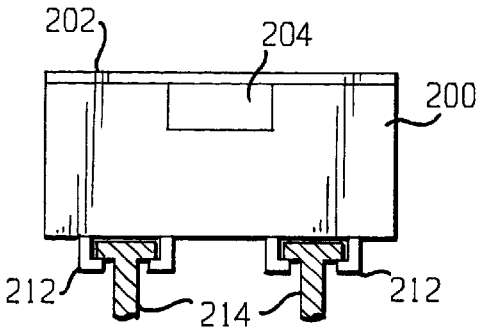
FIGS. 2A and 2B are drawings showing two views of a fixture for holding equipment to be cleaned by the apparatus of FIG. 1.
Figure 2B:
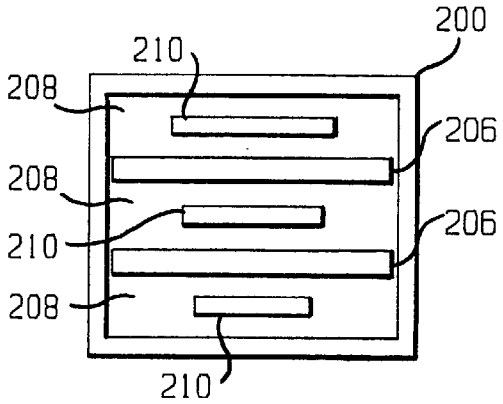

Inside the chamber 102 is a fixture 200 for receiving the equipment to be cleaned. The fixture 200 is shown in a side view in FIG. 1, in a front view in FIG. 2A and from above in FIG. 2B. The fixture 200 is made of thin-gauge expanded aluminum screen, which absorbs impact and provides good thermal transfer. The fixture 200 has a lid 202, not shown in FIG. 2B, that can be held shut with a spring clamp 204 similar to the clamp on the lid of an ammunition box. Inside the fixture 200 are dividers 206 which divide the interior of the fixture 200 into compartments 208. Each item 210 to be cleaned is placed in its own compartment 208 in the fixture 200. The fixture 200 is slidingly mounted by means of two T-slots 212 on two T-slot rails 214 attached to the side walls of the inner wall 104 of the chamber 102 to hold the fixture 200 above the bottom of the chamber 102. Alternatively, the fixture 200 could be mounted for swinging motion on a pendulum.

A drive motor 216 is provided outside of the chamber 102 to supply reciprocating motion to the fixture 200 in order to agitate the fixture 200. The drive motor 216 can be as simple as a reciprocating saw motor. However, it is preferable to use a pneumatic cylinder motor for precise control of the stroke length and frequency of the agitation. The stroke is typically ½", while the frequency is adjustable in a range of 100 to 1,000 cycles per second. The pneumatic cylinder motor 216 runs on air at a pressure of 60 psi. Reed switches 218 are provided to gauge the length and frequency of the stroke. Two cylinder sizes are contemplated: 2½", to accommodate fixtures weighing up to 250 lb; and 8", to accommodate fixtures weighing up to 2,000 lb. Spring shock absorbers, not shown, can be provided to absorb the impact on the drive motor.

The agitating power from the drive motor 216 is conveyed to the fixture 200 by a shaft 220 extending through a bearing 222 in the chamber 102. The bearing 222 can be of steel filled with polytetrafluoroethylene or can be of a graphite-based material.

One or more blower motors 302 are provided between the inner wall 104 and the outer wall 106 to circulate air and the vapors of the $LN_2$ within the chamber 102. The blower motor or motors 302 are located outside the inner wall 104 of the chamber 102 because the extreme temperature changes would freeze the lubricant in the motors 302 or otherwise harm the motors 302. Each blower motor 302 has a shaft 304 extending into the chamber with a fan element 306 in the well known "squirrel cage" configuration. The 2'×2'×2' chamber has one blower motor 302 with a rating of 100 cfm (cubic feet per minute), while the 3'×4'×5' chamber has three such motors 302.

Just underneath each blower motor are two 1,000-watt electric radiant heaters 308, each measuring 23"×2"×2". While one such heater 308 can be provided, is preferable to provide two, both for redundancy in case one heater 308 fails and for rapid heating.

Below the heaters 308 are cryogenic solenoid valves 310, one provided for each blower motor 302. The solenoid valves 310 have ⅜" orifices and introduce $LN_2$ from a storage tank 312 and an $LN_2$ duct 314 into the chamber 102. The $LN_2$ introduced into the chamber 102 through the solenoid valves 310 enters a pan 316 at the bottom of the chamber 102 and evaporates from the pan 316 at a controlled rate.

Thermocouples 318 are provided in the chamber 102 to monitor the temperature. The thermocouples 318 can be T-type or N-type.

The evaporated nitrogen can be vented in any of several manners. A gap can be left between the lid 110 and the walls of the chamber 102 to allow the nitrogen to escape into the atmosphere. Nitrogen can be released into the atmosphere under current EPA rules, since nitrogen is a relatively inert gas and forms the largest component of the atmosphere anyway. However, in some medical settings, the level of nitrogen in the atmosphere must not be allowed to become too high. For such settings, a flow check valve 320 can be provided in the chamber 102 to exhaust the nitrogen through an appropriate exhaust manifold, not shown, to a location where the nitrogen can do no harm.

A computer 400 is provided to operate the apparatus 1 by interfacing with the drive motor 216, the blower motors 302, the heaters 308, the solenoid valves 310, and the thermocouples 318. The computer interfaces with those components through an I/O (input/output) card 402. One such I/O card 402 is produced by Omega and can be installed in a conventional IBM-compatible PC. That card 402 is of high quality with regard to noise and has a capacity of up to eight inputs and eight outputs.

The computer 400 can be an IBM-compatible PC. A Pentium II-based system with 32 MB RAM, which is widely and inexpensively available, has been found to be more than adequate. The computer 400 has an output device such as a display 406 and an input device such as a keyboard 408. A modem, not shown, can be provided for remote analysis.

The computer 400 runs software to operate the apparatus 1. Such software demands little computing power, can be written in a conventional language such as C++ and can run with a character-based interface.

The software prompts the operator for the type of plastic to be cleaned from the equipment by presenting a menu of plastics and identifying a key to be pressed for each plastic. The software then retrieves the settings for that type of plastic. The settings can be changed by an authorized person, e.g., at the factory, but not by the operator of the apparatus 1. The operator is prompted to press another key to start the cycle. Once that key is pressed, the air solenoid 118 is controlled to lock the lid 110 shut.

Once the settings for the plastic to be removed are retrieved and the cycle is started, the software uses time and the temperature measured by the thermocouples 318 as its inputs. During the heating phases of the cycle, the software controls the heaters 308 to ramp up the temperature to a desired level and to maintain the temperature at the desired level. During the cooling phases of the cycle, the temperature is lowered at a rate of 10° F./minute to keep the $N_2$ in vapor form, since faster cooling would cause condensation of $LN_2$ outside the pan 316.

The software monitors the various components of the chamber 102 through the I/O card 402, controls them as needed and detects failed components. For example, the heaters 318 are cycled on and off as needed, whereas the blower motors 302 operate continuously and are monitored only to detect failure. The software can alert the operator of any component failure and can even shut the apparatus 1 down if needed.

During the cycle, the software displays two pie charts on the display 406 of the computer 400. The first pie chart shows the operator the part of the entire cycle that has been performed, while the second pie chart shows the operator the part of the current stage in the cycle that has been performed. The software can also provide a display of what components are on or off and of all of the different operations.

Figure 3:
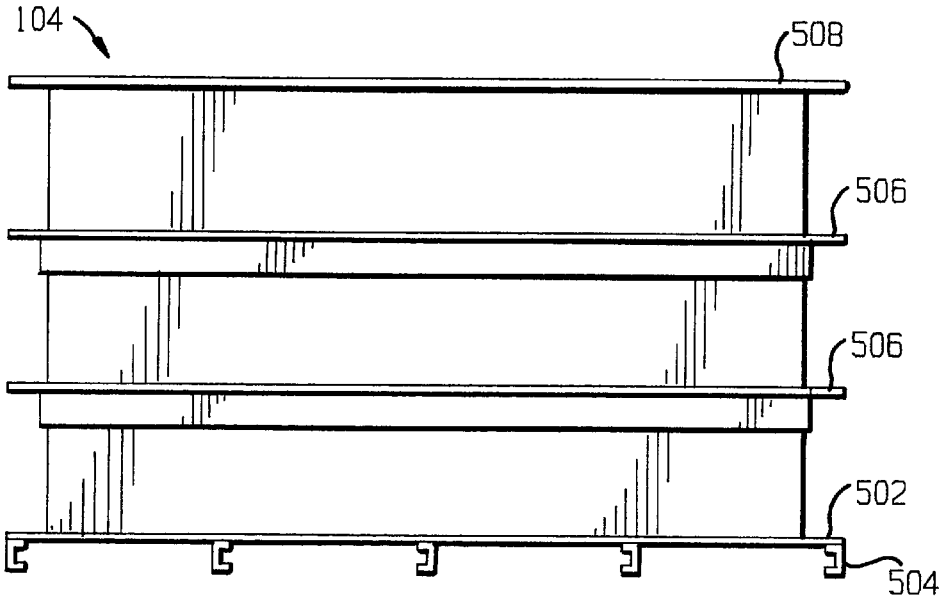
FIG. 3 is a drawing showing a detail of construction of an inner wall of a chamber in the apparatus of FIG. 1.

A particular construction of the inner wall 104 of the chamber 102 is shown in FIG. 3. The inner wall 104 has a bottom plate 502 formed of ¼" stainless steel plate. The bottom plate 502 has multiple C-channel pieces 504 that reinforce the bottom plate 502 and support the weight of the inner wall 104 while providing spacing for the insulation 108. Also providing reinforcement and spacing for the insulation 108 are angle pieces 506 provided on all four sides of the inner wall 104; as shown, the angle pieces 506 can be provided in two tiers. Completing the inner wall 104 is an upper ledge piece 508.

Figure 4:
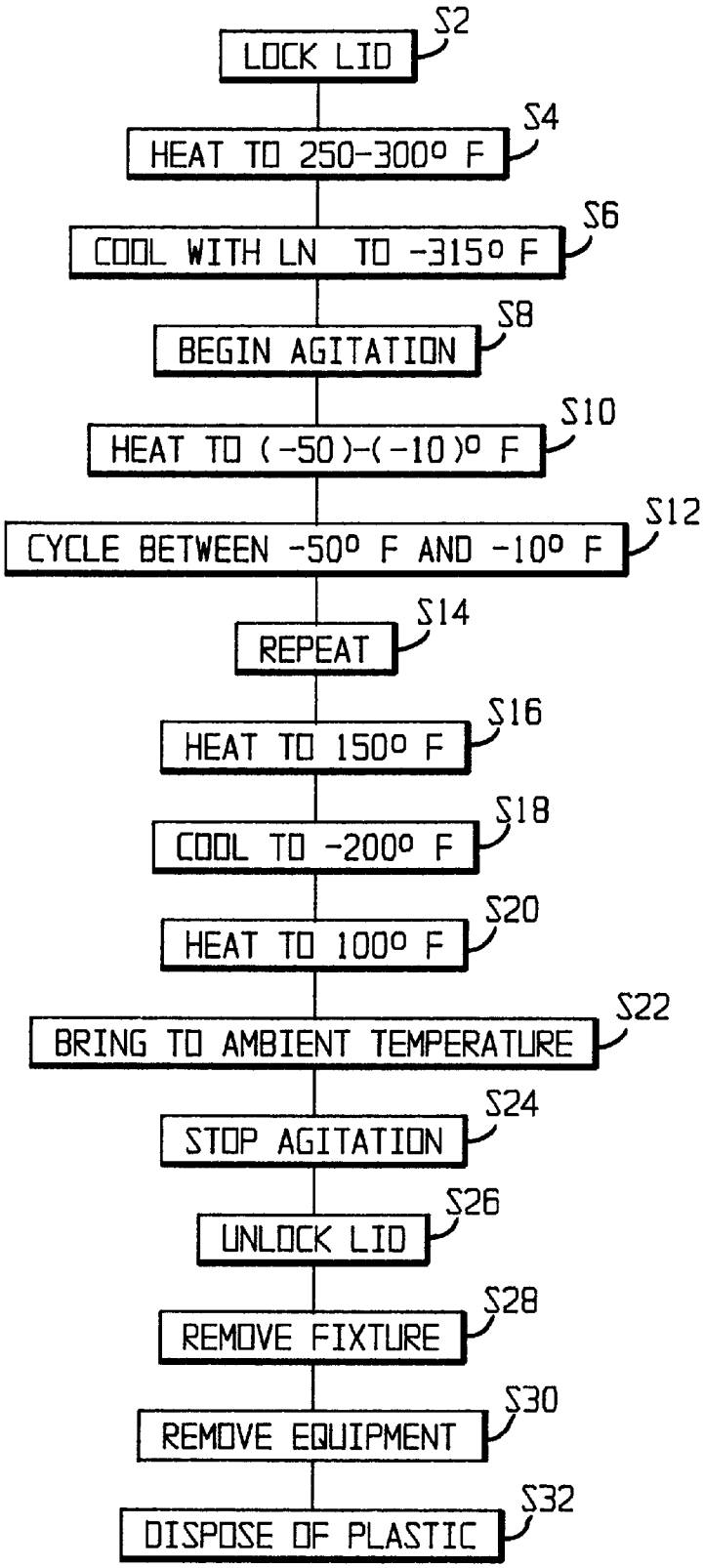
FIG. 4 is a flow chart of operational steps carried out in the apparatus of FIG. 1.

A cleaning operation will now be set forth in detail with reference to FIG. 4. Such a cleaning operation is illustrative rather than limiting and can, of course, be adapted to the plastic or other material to be removed.

Once the lid is locked at step S2, the chamber is heated at step S4 to 250–300° F. to grow the equipment slightly. Since the steel expands more rapidly than does the plastic, the plastic begins to break. The temperature is maintained at that level for five minutes.

The equipment is shrunk rapidly at step S6 by filling the pan with $LN_2$ and cooling the equipment in the vapors of the $LN_2$ to a temperature of −315° F. The steel contracts more rapidly than the plastic, which thus starts to pull away from the steel. While the equipment is being cooled in that manner, the agitation of the fixture begins at step S8 and continues for the rest of the cleaning process. That agitation helps the thermal cycle to remove the plastic from the steel, so that impact cleaning is not needed.

Then, to cause the plastic to undergo a phase transition between its ductile and brittle states, the chamber is heated at step S10 to a temperature between −50° F. and −10° F. That heating causes the plastic to undergo a phase transition between its ductile and brittle states. The temperature is cycled twice, at steps S12 and S14, between −50° F. and −10° F. to fatigue the plastic.

After those two cycles, the temperature is elevated to 150° F. at step S16 to weaken the plastic further. The temperature is then plunged back down to −200° F. at step S18, elevated to 100° F. at step S20 and finally brought to ambient temperature at step S22. At that time, the agitation is stopped at step S24.

Once the inside of the chamber is at ambient temperature, the air solenoid is released to unlock the lid of the chamber at step S26. The fixture with the equipment therein is removed at steps S28 and S30. The plastic cleaned from the equipment has accumulated at the bottom of the fixture and can easily be disposed of at step S32.

While a preferred embodiment of the present invention has been set forth above, those skilled in the art who have reviewed the present disclosure will readily appreciate that other embodiments can be realized within the scope of the present invention. For example, fixtures other than the one disclosed above can be provided to agitate pieces having particular shapes. Also, other heating and cooling techniques can be used; in particular, cryogens other than $LN_2$ can be used. Moreover, operations disclosed as being automated can be performed manually, and vice versa. Therefore, the present invention should be construed as limited only by the appended claims.

I claim:

1. A method of cleaning residue of a material from equipment used in processing the material, the method comprising the following steps:

(a) thermally cycling the equipment between a first temperature and a second temperature which is different from the first temperature such that the equipment is exposed to each of the first and second temperatures at least twice;

(b) agitating the equipment during step (a) to loosen the residue of the material from the equipment so as to clean the residue of the material from the equipment; and (c) before step (a):

exposing the equipment to a third temperature which is higher than either of the first and second temperatures; and then exposing the equipment to a fourth temperature which is lower than any of the first, second and third temperatures.

2. The method of claim 1, wherein the fourth temperature is a temperature of a cryogen.

3. The method of claim 1, further comprising, after step (a):

exposing the equipment to a fifth temperature which is higher than either of the first and second temperatures;

then exposing the equipment to a sixth temperature which is lower than either of the first and second temperatures;

then exposing the equipment to a seventh temperature which is higher than either of the first and second temperatures; and then exposing the equipment to ambient temperature.

4. The method of claim 3, wherein:

each of the fifth and seventh temperatures is lower than the third temperature; and the sixth temperature is higher than the fourth temperature.

5. An apparatus for cleaning residue of a material from equipment used in processing the material, the apparatus comprising:

thermal cycling means for thermally cycling the equipment between a first temperature and a second temperature which is different from the first temperature such that the equipment is exposed to each of the first and second temperatures at least twice; and agitating means for agitating the equipment to loosen the residue of the material from the equipment so as to clean the residue of the material from the equipment while the thermal cycling means thermally cycles the equipment;

wherein the thermal cycling means comprises means for (i) exposing the equipment to a third temperature which is higher than either of the first and second temperatures; (ii) then exposing the equipment to a fourth temperature which is lower than any of the first, second and third temperatures; and (iii) then thermally cycling the equipment between the first and second temperatures.

6. The apparatus of claim 5, wherein the fourth temperature is a temperature of a cryogen.

7. The apparatus of claim 5, wherein the thermal cycling means further comprises means for, after the equipment is thermally cycled, exposing the equipment to a fifth temperature which is higher than either of the first and second temperatures, then exposing the equipment to a sixth temperature which is lower than either of the first and second temperatures, then exposing the equipment to a seventh temperature which is higher than either of the first and second temperatures and then exposing the equipment to ambient temperature.

8. The apparatus of claim 7, wherein:

each of the fifth and seventh temperatures is lower than the third temperature; and the sixth temperature is higher than the fourth temperature.

* * * * *